United States Patent [19]

Shifferaw

[11] Patent Number: 4,725,057

[45] **Date of Patent: * Feb. 16, 1988**

[54] UNIVERSAL EXERCISING MACHINE

[76] Inventor: Tessema Shifferaw, 2048 McAllister St., San Francisco, Calif. 94118

[ * ] Notice: The portion of the term of this patent subsequent to Nov. 4, 2003 has been disclaimed.

[21] Appl. No.: 926,950

[22] Filed: Nov. 3, 1986

Related U.S. Application Data

[63] Continuation of Ser. No. 604,948, Apr. 27, 1984, Pat. No. 4,620,704.

[51] Int. Cl.[4] ..... A63B 21/02

[52] U.S. Cl. ..... 272/135; 272/134; 272/136; 272/143

[58] Field of Search ..... 272/135, 136, 143–145, 272/134, 93, 72, 117

[56] References Cited

U.S. PATENT DOCUMENTS

| | | | |
|---|---|---|---|
| 192,338 | 6/1877 | Marshall | 272/135 |
| 3,658,327 | 4/1972 | Thiede | 272/134 X |
| 3,708,167 | 1/1973 | Potgieter | 272/117 |
| 3,981,500 | 9/1976 | Ryan | 272/136 X |
| 4,063,727 | 12/1977 | Hall | 272/136 |
| 4,620,704 | 11/1986 | Shefferan | 272/136 X |

*Primary Examiner*—Richard J. Apley
*Assistant Examiner*—J. Welsh
*Attorney, Agent, or Firm*—Flehr, Hohbach, Test, Albritton & Herbert

[57] ABSTRACT

Exercising machine having a plurality of resilient rods which are flexed and resist movement of a person using the machine. Forces are exerted on the resilient rods through cables to which a variety of attachments such as hand grips, foot stirrups and a sliding bench can be connected to exercise different parts of the body. The rods can be used in any combination to suit the requirements and physical abilities of the person using the machine.

29 Claims, 22 Drawing Figures

FIG_2
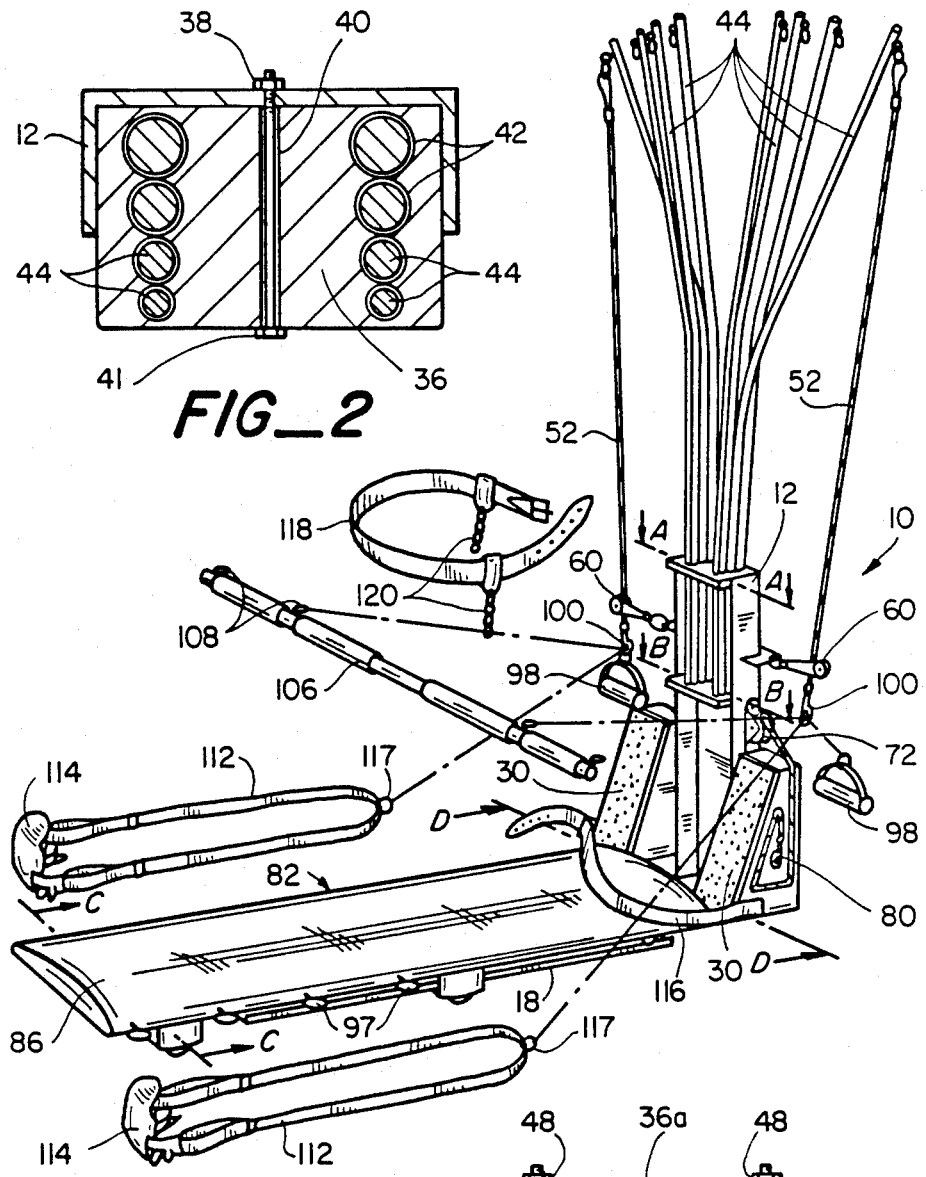
FIG_1
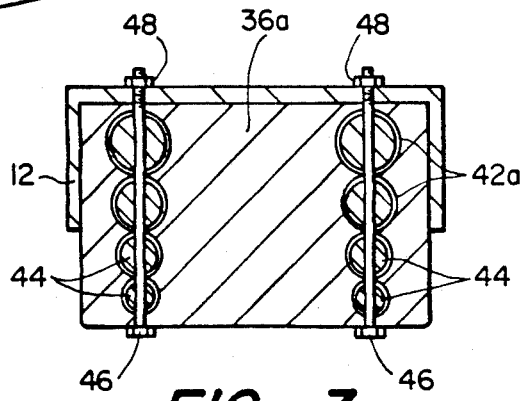
FIG_3

UNIVERSAL EXERCISING MACHINE

This is a continuation of application Ser. No. 604,948 filed Apr. 27, 1984, now U.S. Pat. No. 4,620,704.

BACKGROUND--FIELD OF THE INVENTION

The present invention relates to exercising machines, particularly to exercising machines of the type using resilient loading elements.

BACKGROUND--DESCRIPTION OF PRIOR ART

Nowadays various types of exercising machines and devices are available on the market. One conventional exercising device, shown in U.S. Pat. No. 4,205,839 to M. Best, issued 1980 June 3, comprises a pair of cords which pass over sheaves in pulley blocks carried on a rigid member pivotally attached to a fixed support. One end of each cord is hand held, ant the other end is provided with foot stirrups for the user's feet. In operation, the resistance or load for the arm muscles is provided by the force applied from legs, and vice-versa. An exercising device of this type, however, does not possess versatility and cannot be used for exercising and developing various types of a person's body muscles. Furthermore, it is not a self-contained device: i.e., it cannot be utilized in a variety of locations since it requires an appropriate fixed or stationary support.

Another known exercising device is disclosed in U.S. Pat. No. 4,185,816 to M. Bernstein, issued 1980 Jan. 29. This device is a sit-up exercising apparatus which is adapted to be utilized in conjunction with a door. The apparatus comprises a U-shaped frame which is inserted beneath the door and which is provided with means for rigid attachment to the door. The U-shaped frame is used as a support for a bracket carrying a bar; the bar is used, in the course of exercising, as a foot support. This device also possesses a number of disadvantages, the main ones being lack of versatility and a restricted field of application since it is suitable only for the development of abdominal muscles.

Another exercising machine of a self-contained type, which is now produced by Marcy Fitness Products under the trademark BODYBAR, is illustrated in "1984 Spring and Summer Supplement Consumers Catalog", (Consumers Distributing, 205 Campus Plaza, Edison, N. J. 08837), CD-3, page 149[3], items C and D. This apparatus comprises an upright rigid frame which is used for guiding an adjustable weight attached to a cable which is threaded through a pulley system. The free end of the cable is attached to a hand grip. The apparatus is provided with a removable bench which carries a leg support connected to the weight through a cable and a lower pulley. Although this apparatus is self-contained, it cannot be used universally for developing various groups of muscles, as well as for aerobic exercises. For example, it cannot be used as a bicycle simulator. Moreover, this device is heavy, occupies much space, is expensive to manufacture, and is incovenient for transporation and storage. Since the resistance is provided by weights, this apparatus cannot be used in a spaceship for astronauts' training under weightlessness conditions.

Some conventional exercisers are based on the principle of gas-filled cylinders. One such device, which is produced by M.& R. Industries, Inc. (9215—151st Avenue NE, Redmond, WA 98052) comprises a frame with a slidable seat and foot supports. It is provided with a pair of air cylinders attached to both sides of the frame and corresponding pivotal handles which are connected to the piston rods of the cylinders' pistons. This exerciser can simulate rowing as well as other exercises: a user swings the pivotable handles to displace air from the cylinders. This device lacks versatility and provides but a one-directional resistance. Thus it does not provide continuous loading and requires extra time for returning the pistons to their original positions, resulting in poor efficiency.

OBJECTS AND ADVANTAGES OF THE PRESENT INVENTION

Accordingly several objects of the present invention are to provide a universal exercising machine which is cheap in price, simple to manufacture, easy to use, and versatile. Also it enables an individual to perform a great variety of aerobic, isotonic, and stretching exercises. It is light in weight, portable, and convenient for storage. The device of the present invention can be used for astronauts' training under weightlessness conditions. Further objects and advantages of the present invention will become apparent from a consideration of the ensuing description and drawings.

BRIEF DESCRIPTION OF DRAWINGS

FIG. 1 is a general perspective view of a universal exercising machine of the present invention with various attachments connected to their corresponding points of fixation by dotted lines.

FIG. 2 is a cross-sectional view taken in the direction of lines A—A in FIG. 1.

FIG. 3 is a cross-sectional view taken in the direction of lines B—B in FIG. 1.

DETAILED DESCRIPTION OF THE INVENTION

Figure 4:
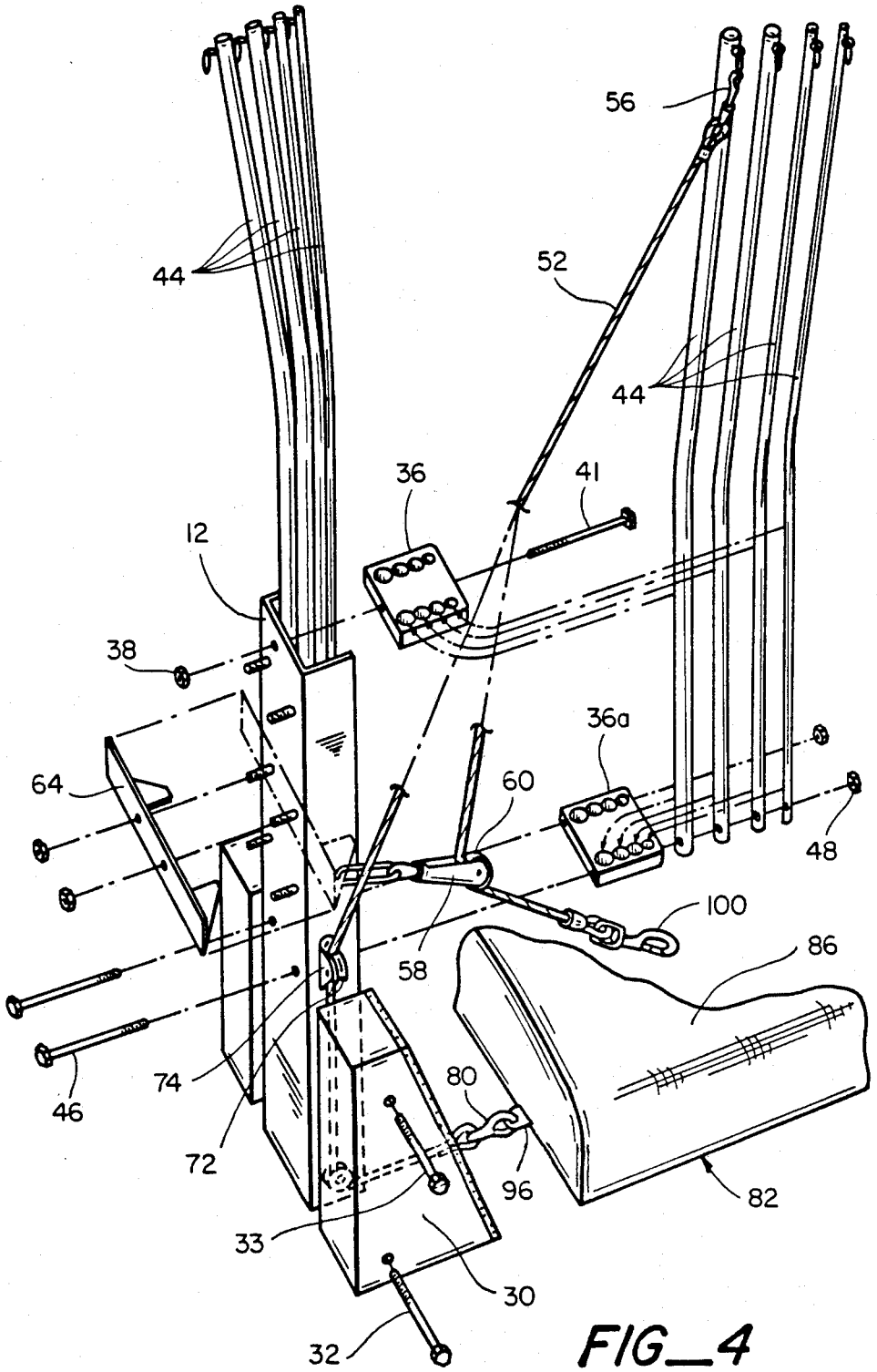
FIG. 4 is an exploded perspective view of the machine of FIG. 1 illustrating the attachment and interconnection of various parts thereof.

Referring now to FIG. 1, which is a perspective view of a universal exercising machine of the present invention with various attachments, and to FIGS. 2–11, which show various details and interconnections between parts, the machine comprises a rigid frame or base 10 having an upright U-shaped post 12 and a short horizontal leg 14 rigidly connected to post 12, e.g., by means of triangularly-shaped side corner plates 16. An elongated section 18 is hinged to leg 14 by means of a hinge 20, which is clearly shown in Fig. 9. As will be explained further, this hingeable connection is used for folding the machine into a collapsed position for storage or transportation.

Figure 9:
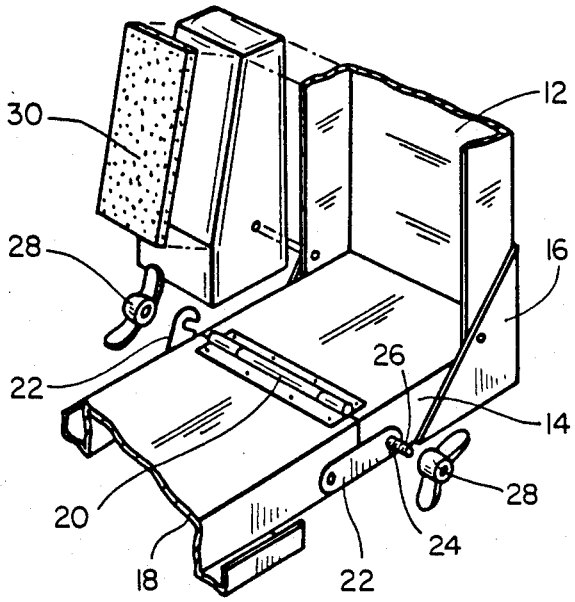
FIG. 9 is a partially exploded, fragmentary perspective view of the base portion of the machine.
Figure 11:
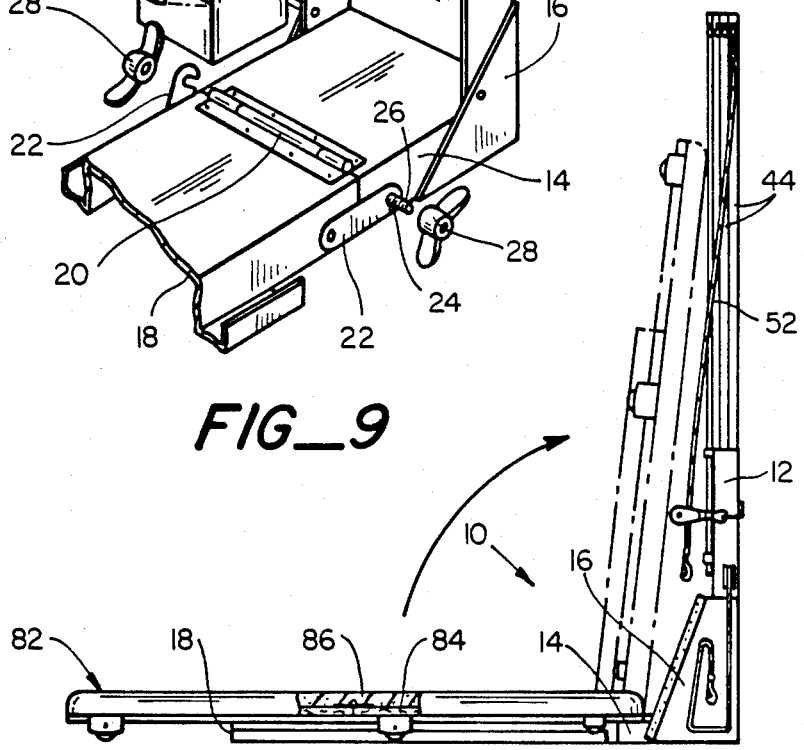
FIG. 11 is a side view of the device of the present invention; broken lines show how the machine collapses for storage or transportation.

In its working or unfolded position, base section 18 is fixed by means of hooks 22 pivotally attached to the sides of base section 18 and engageable with pins 24 which protrude outwardly from horizontal leg 14. Pins 24 are provided with threaded ends 26 for engagement with wing nuts 28 which fix the hooks in their engaged position and, hence, base 10 in its unfolded position (FIG. 9).

Figure 8:
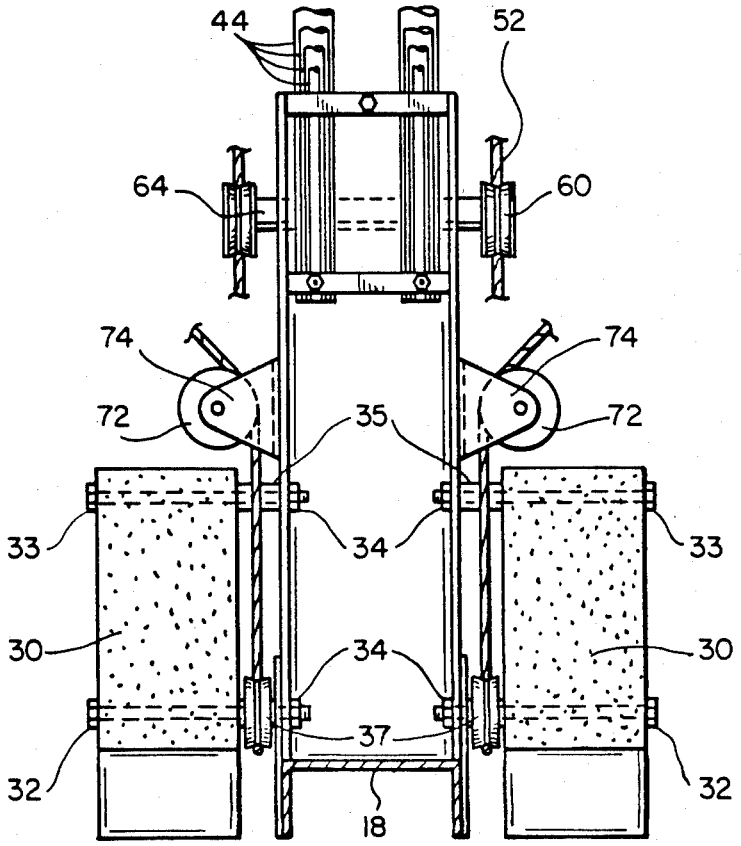
FIG. 8 is a cross-sectional view taken in the direction of lines D—D in FIG. 1.

The exercising machine is provided with foot supports 30 which comprise triangularly-shaped blocks, one for each foot on the left and right sides of upright post 12 to which they are attached, e.g., by bolts 32 and 33 and nuts 34 (FIG. 8). Upper bolts 33 pass through spacers 35 located between the inner sides of foot supports 30 and outer walls of upright posts 12, whereas sheaves 37 are located and rotatably mounted in corresponding lower spaces on bolts 32 between the inner sides of foot supports 30 and outer surfaces of upright post 12. The purpose of sheaves 37 will be explained later.

Base 10, including horizontal leg 14, corner plates 16, and base section 18 can be made of a light metal, such as aluminum or aluminum alloy, or of any other suitable material.

A retainer 36 is inserted into the upper interior portion of U-shaped post 12 and is attached thereto by bolts 41 and nuts 38 (FIGS. 2). Bolts 41 pass through holes 40 provided in retainer 36. Retainer 36 can be made of a plastic, wood ,or metal.

A second retainer **36*a* is inserted into the lower interior portion of U-shaped post 12. Two symmetrically arranged sets of holes 42 and 42*a* are drilled or formed by any other suitable method in both retainer 36 and 36*a* respectively. In the assembled state of retainers 36 and 36*a*, holes 42 and 42*a* in both retainers are aligned with respect to each other. These holes receive respective cantilevered resilient rods or arms 44, the free ends of which extend upward from retainer 36 and base 10. Resilient rods 44 may be of different diameters and are preferably made from nylon. Their diameter may vary from 6 mm (¼") to 51 mm (2"). Lower ends of resilient rods 44 are fixed in retainer 36*a* by transverse bolts 46 with nuts 48. Bolts 46 pass through aligned holes drilled in retainer 34 and the lower ends of the rods. The rods are thus free to bend in bow-like fashion, as illustrated in FIGS. 12–22**, and produce a force in opposition to the force which bends them.

Figure 6:
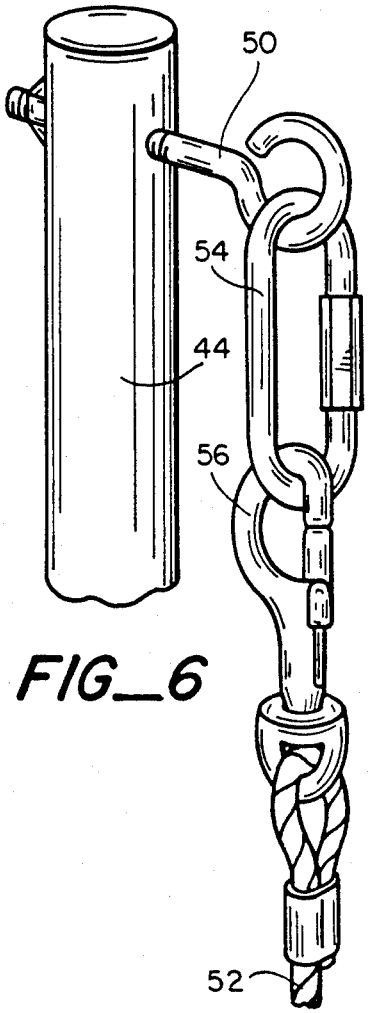
FIG. 6 is a view illustrating the attachment of a cable of the machine to resilient rods thereof.

As shown in FIGS. 1 and 6, eye bolts 50 are attached to the upper ends of resilient rods 44. Hand cables 52 are connected to eyelets of said bolts through detachable links 54 and spring clips 56 (FIG. 6).

Figure 5:
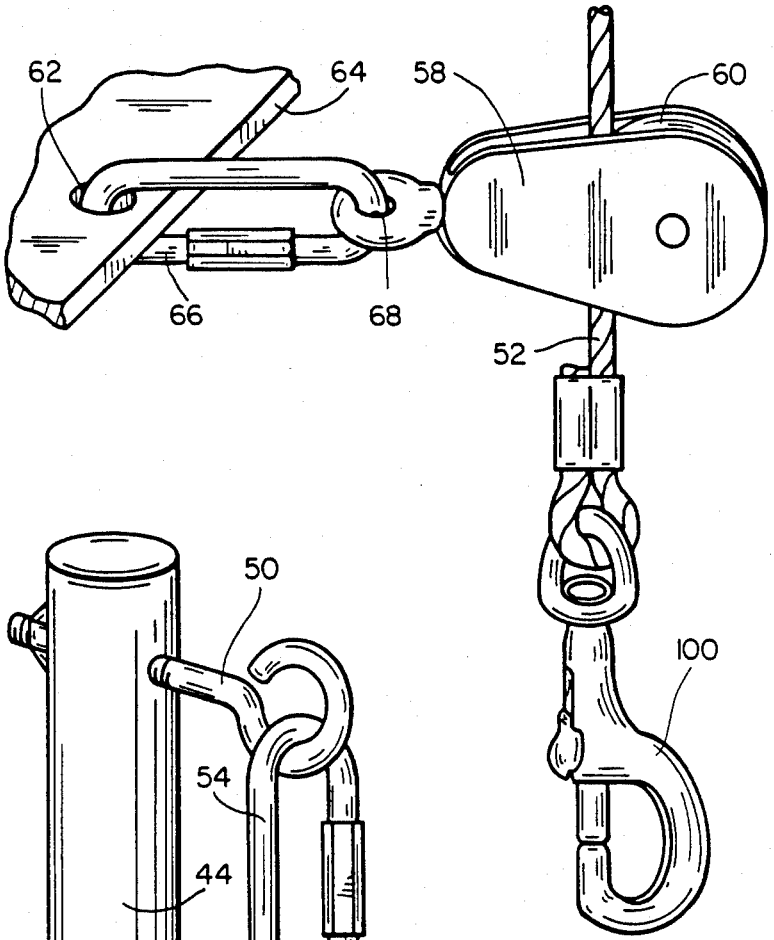
FIG. 5 is a view illustrating the attachment of a hinged pulley of the machine to its frame.

A yoke 58 with a sheave 60 is pivotally attached to each side wall of upright post 12 (FIG. 5). This attachment is made through an eye bolt 62, fixed to upright post 12 by nuts 64, and intermediate detachable link 66 which passes through the eyelet of bolt 62 and a hole of yoke 58. The connection described above functions as a universal joint which enables the yoke to rotate freely in a wide range. Free ends of hand cables 52 pass through yoke 58 and are guided by sheaves 60. Spring clips 70 are attached to the ends of hand cables 52.

Another pair of sheaves 72 is supported by brackets 74; each bracket 74 is rigidly fixed to the left and right outer walls of upright post 12, respectively, so that sheaves 72 lie in a transverse vertical plane. Foot cables 76 with spring clips 78 and 80 (FIG. 4) at their ends are guided by sheaves 72 so that upper ends of the foot cables can be connected to detachable links 54 on the upper ends of resilient rods 44, whereas their lower ends can be connected to a slidable bench described hereinafter.

Figure 7:
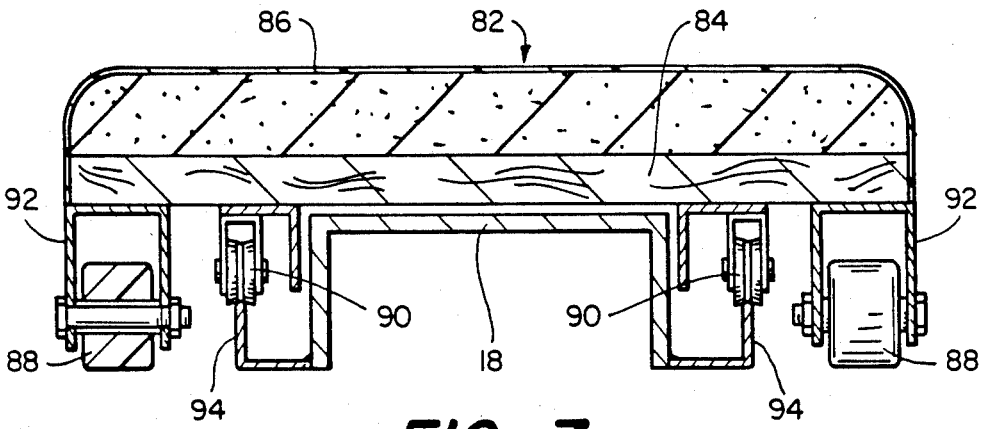
FIG. 7 is a cross-sectional view taken in the direction of lines C—C in FIG. 1.
Figure 10:
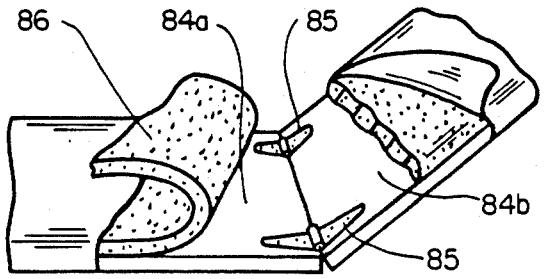
FIG. 10 is a partial perspective view illustrating a hingeable connection of parts of a slidable bench of the machine.

A slidable bench 82 comprises a padded wooden frame 84 which is covered with soft vinyl 86 or any other suitable material; covering 86 is attached to the upper surface of the frame. Frame 84 consists of two parts, **84*a* and 84*b*, which are pivotally interconnected by hinges 85 (FIG. 10). The bench is provided with two pairs of floor wheels 88 and one pair of base wheels 90. Wheels 88 are mounted in U-shaped brackets 92 arranged on the left and right sides of the bench symmetrically with respect to the longitudinal axis of the exerciser (FIG. 7). Base wheels 90 roll on rails 94 which are attached to or made integrally with base section 18. Thus bench 82 can be moved (with respect to upright post 12 and base section 18) on wheels 88 and 90. Eye bolts 96 ( only one of which is shown in FIG. 4) are engaged with spring clips 80 and are attached to the front end of bench 82 so as to face upright post 12. These eye bolts are used for attaching the bench to foot cables 76**.

Rings 97 are attached in various positions to the sides of bench 82. These rings serve as additional means of attaching various elements of the harness. The harness in turn is used to secure an individual's body—or handles which the individual may hold with his or her hands while doing leg exercises. This will be explained further with reference to the description of the operation of the exerciser.

The universal exercising machine of the present invention is provided with various attachments which broaden its applications and enable an individual to perform an endless variety of physical exercises for developing various groups of his or her muscles (FIG. 1). These attachments comprise two hand grips 98 (for the left and right hands respectively) attachable to hand cables 52 through spring clips 100 connected to the lower ends of the cables. These hand grips may have any form convenient for holding. In the illustrated embodiment, each hand grip 98 comprises an U-shaped yoke with a handle 102 for the individual's hand and with a ring 104 attachable to spring clip 100. With the use of these hand grips, an individual can work with each hand independently.

A single stick bar 106 can be used instead of separate hand grips 98 when one desires to work with both hands simultaneously. A series of rings 108 are provided on stick bar 106 for selecting various cable attachment positions with regard to physical abilities of the individual and his or her personal requirements. Rings 108 can also be attached to spring clips 100.

Another attachment comprises two foot straps 110 formed by belts 112 with stirrups 114 at one end and attachment rings at the other end. The belts are adjustable to match the individual's height. This attachment is used for simulating bicycle driving and for stretching, as will be explained further with reference to the machine's operation.

Another element of the harness is a waist strap 116, which is attached to foot support 30 (FIG. 1) and is used as an airplane seat belt when the individual exercises in a seating position facing away from upright post 12. Waist strap 116 also can be used for securing an austronaut's body to the machine when the austronaut performs exercises in a spaceship under weightlessness conditions.

A second belt 118 is provided with chains 120 which can be attached, e.g., to spring clips 100 at the ends of cables 52. This belt can be fastened around the individual's waist for one type of exercise, or it can be used as an additional means for attaching the individual's body to the upright post in another type of exercise, i.e., when the individual assumes a sitting position with his or her back to the upright post and belt 118 around his or her chest.

When not in use, the universal exercising machine of the present invention can be folded into an inoperative position which is very convenient for transportation or storage. For this purpose, wing nuts 28 are loosened (FIG. 9), hooks 22 are disconnected from pins 24, and the hinged base section 18 is turned in the direction of the arrows in FIG. 11, along with bench 82, to a position shown by the broken lines in FIG. 11. In a folded state the machine will occupy a space of about 15×30×107 cm (6"×12"×42") and this can be rolled into any closet. The whole machine weighs 17 kg (38 lb).

Operation of the Machine of the Present Invention

Operation of the universal exercising machine of the present invention will be described further with reference to FIG. 1 and FIGS. 12–22.

In FIGS. 12–22 an individual P is shown schematically. Motions of such individual's arms, legs, or body, as well as motions of the movable parts of the machine, are illustrated by broken lines. The resistance is provided by resilient rods 44; these can be used in any combination to suit the individual's requirements and physical abilities. Given below are various types of exercises in connection with various positions of the individual and the use of the various attachments.

Figure 12:
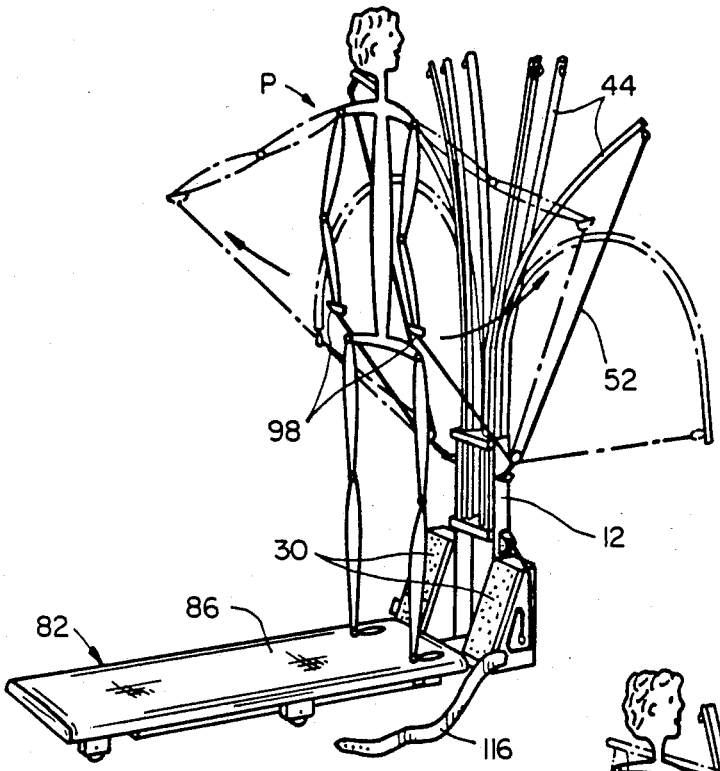
FIGS. 12 to 20 illustrate various applications of the exercising machine of the present invention with the bench disconnected from the lower pulley system.

In FIG. 12, individual P is shown in a standing position facing resilient rods 44. The individual holds hand grips 98, the latter being attached to hand cables 52. The individual is shown doing shoulder and arm exercises: the individual lifts his or her arms from a straight-down position into positions shown by broken lines, i.e. to the back and up, to the front and up, etc. Only one resilient rod 44 is employed for ease of illustration, but a plurality can be employed for stronger individuals by connecting the free ends of several adjacent resilient rods 44 together, e.g., by inserting detachable link 54 (FIG. 6) into eyelet bolts 50 of these rods 44.

Figure 13:
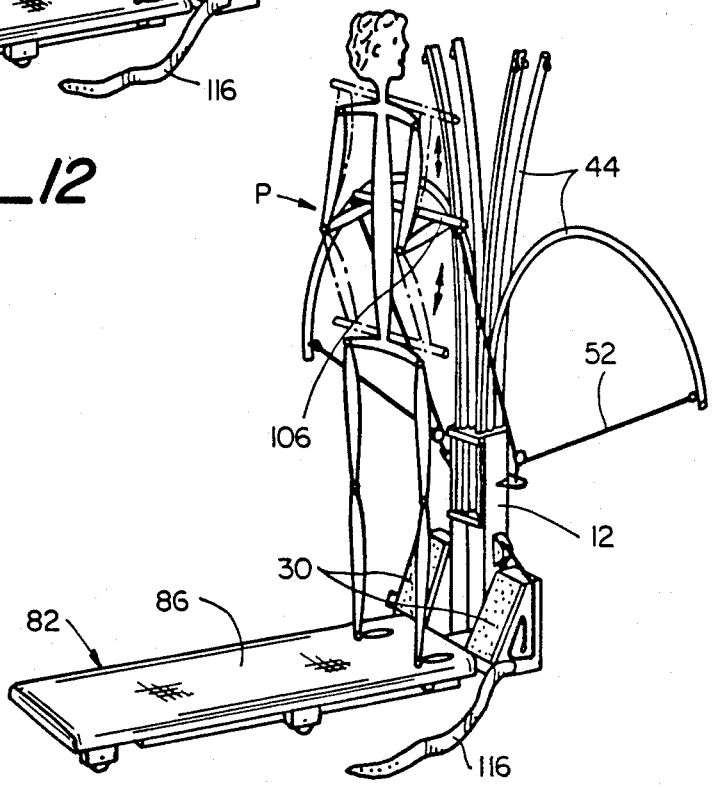

FIG. 13 illustrates the individual in the same position as shown in FIG. 12. Stick bar 106, however, is attached to hand cables 52 instead of separate hand grips 98. The individual works with the bar with both hands simultaneously swinging his or her arms and performing knee-bends, thereby to develop his or her biceps, forearm muscles, and calf muscles.

Figure 14:
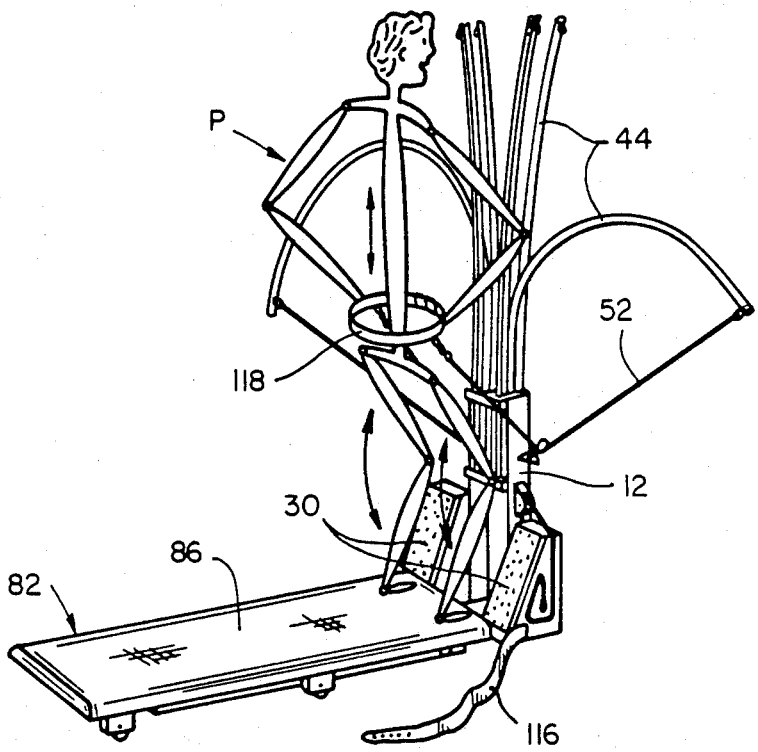

In FIG. 14 the individual is in the same position as in Fig. 12 with belt 118 fastened around his or her waist and attached to hand cables 52. An individual is doing knee-bends so as to work with the thigh muscles.

Figure 15:
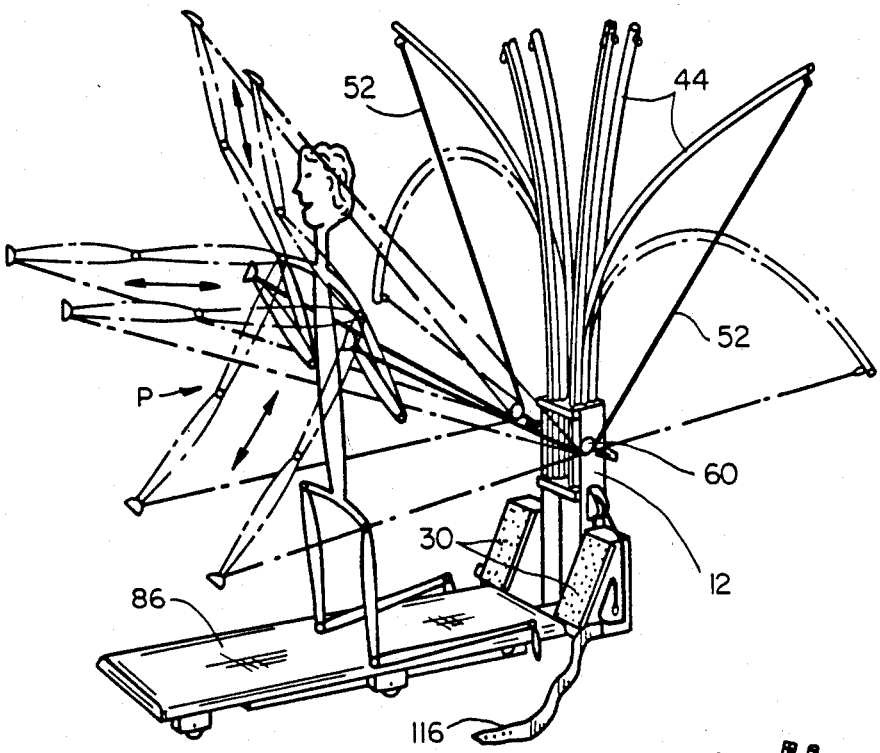

In FIG. 15 an individual is shown on his or her knees facing in a direction opposite to resilient rods 44. The individual uses separate hand grips 98 or single stick bar 106 for working the chest and hand muscles.

Figure 16:
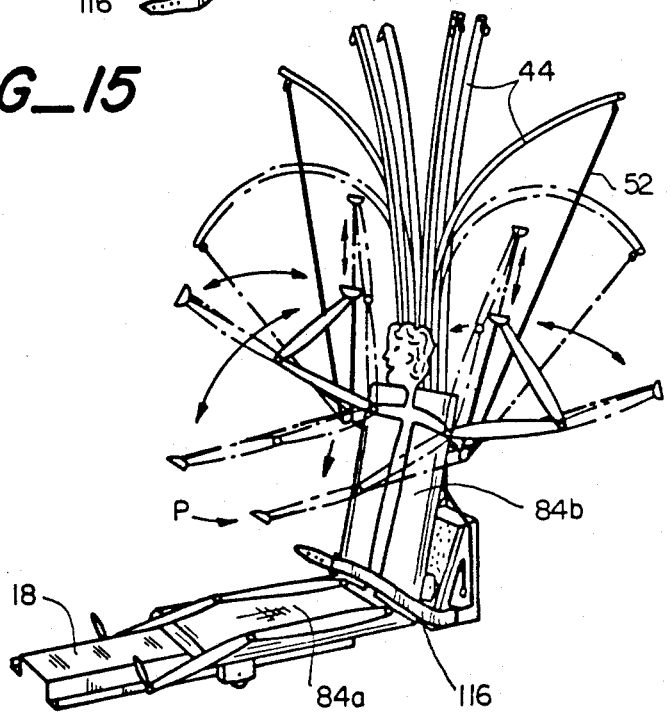

FIG. 16 illustrates the individual in a seating position facing in a direction opposite to resilient rods 44. For this position bench 82 is converted into a seat by folding it around hinges 85 (FIG. 10) and leaning part **84*b* of the bench against upright post 12. The individual is fastened by waist strap 116 and works with his or her shoulders, chest and triceps. Both separate hand grips 98 or stick bar 106** can be used in this position.

Figure 17:
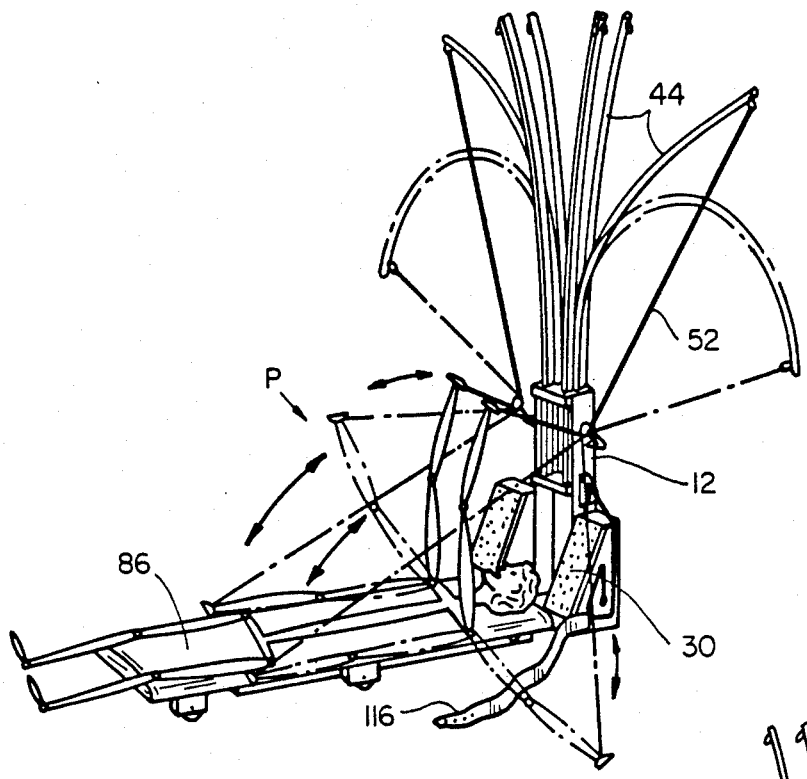

FIG. 17 shows the individual in a supine position on the bench with his or her head towards upright post 12. Separate hand grips 98 or single stick bar 106 can be used for exercising in this position. Triceps, chest and shoulder muscles are developed by pushing and spreading the individual's arms. This exercises immitates swimming.

Figure 18:
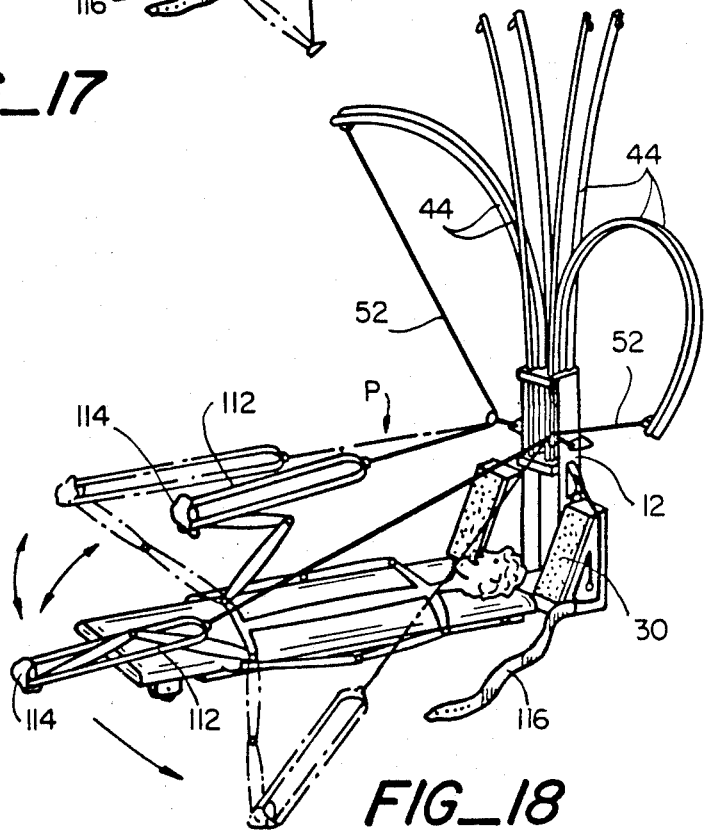

In FIG. 18 the individual is in the same position as in Fig. 17. The individual holds hand grips 98 attached to corresponding rings 97 on the bench. The feet are inserted into stirrups 114 of foot straps 110. Working the legs, the individual immitates pedaling a bicycle in order to load the heart. It is possible in this position also to immitate running or working, or to spread the legs apart for loading other groups of muscles, as is illustrated by broken lines in FIG. 18.

In FIG. 19 the individual is again in a supine position, but facing the resilient rods and with feet planted against foot supports 30. The individual develops the biceps, triceps, forearm, and shoulder muscles by pulling hand cables 52 or spreading the arm apart.

Figure 20:
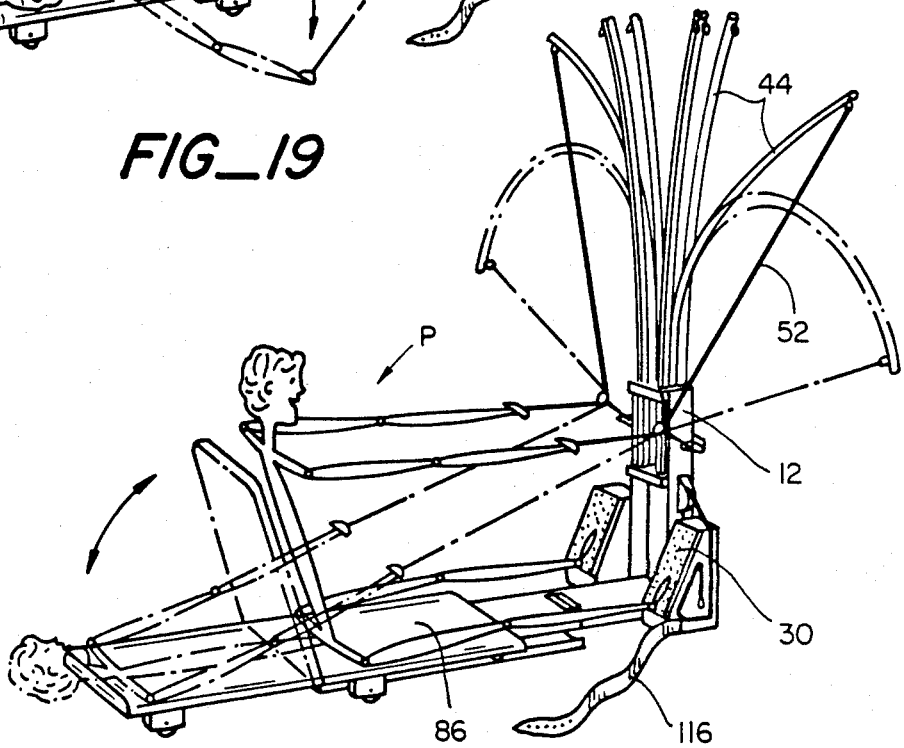

In FIG. 20 the individual is in a sitting position facing the machine. The abdomen muscles are loaded by doing situps.

The exercises illustrated in FIGS. 12–20 are performed with bench 82 in a stationary position. The exercising machine of the present invention, however, enables individual P to execute also a variety of physical exercises with the movable bench. For this purpose, spring clips 78 are attached to the upper ends of resilient rods 44, whereas spring clips 80 are attached to corresponding eye bolts 96 on bench 82. Thus the bench appears to be connected to the load through foot cables 76 and can slide with respect to the floor and base 18 on wheels 88 and 90 respectively.

Figure 21:
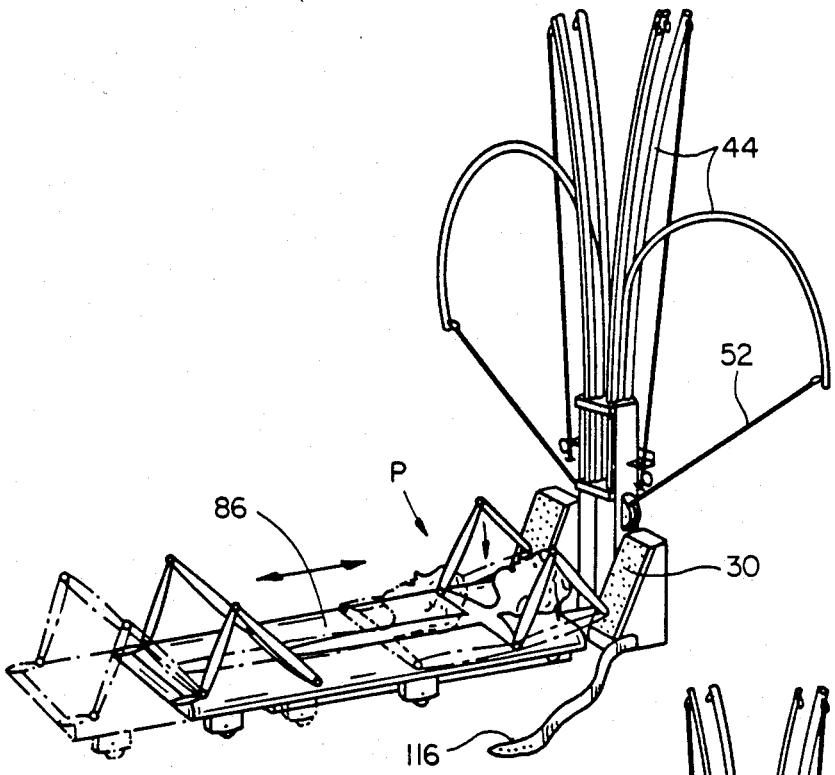
FIGS. 21 and 22 illustrate various applications of the exercising machine of the present invention with the bench slidable on the base.
Figure 22:
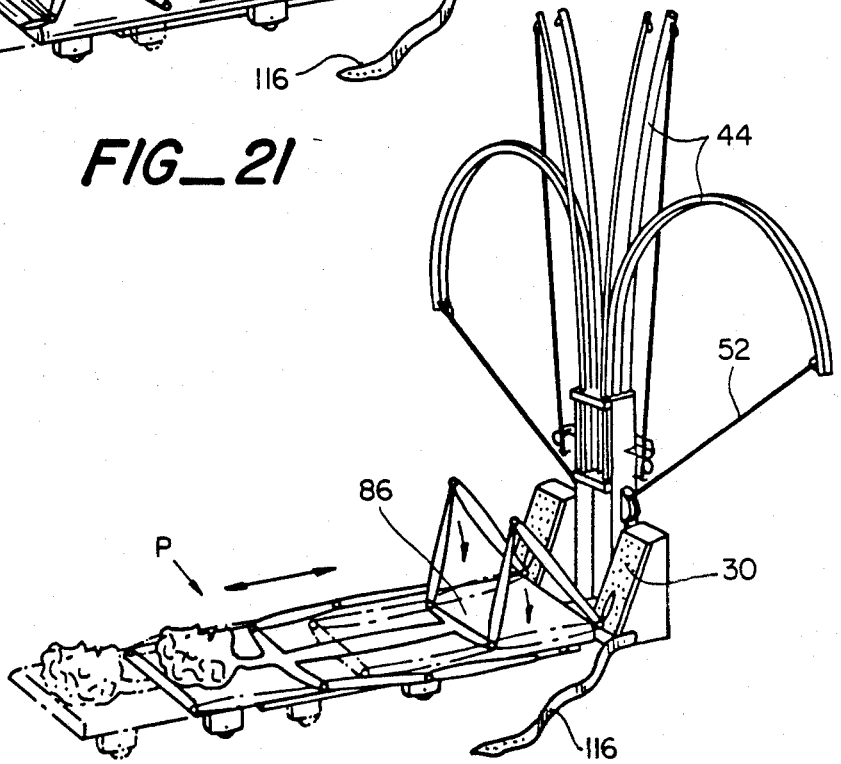

Typical exercises with the slidable bench are illustrated in FIGS. 21 and 22. In FIG. 21 individual P is shown in the same position as in FIGS. 17 and 18. The individual pushes his or her body, together with the bench, away from upright post 12, overcoming the resistance exerted by resilient rods 44. In this case the individual exercises his (her) hands, bicepse, triceps, and other muscles.

Figure 19:
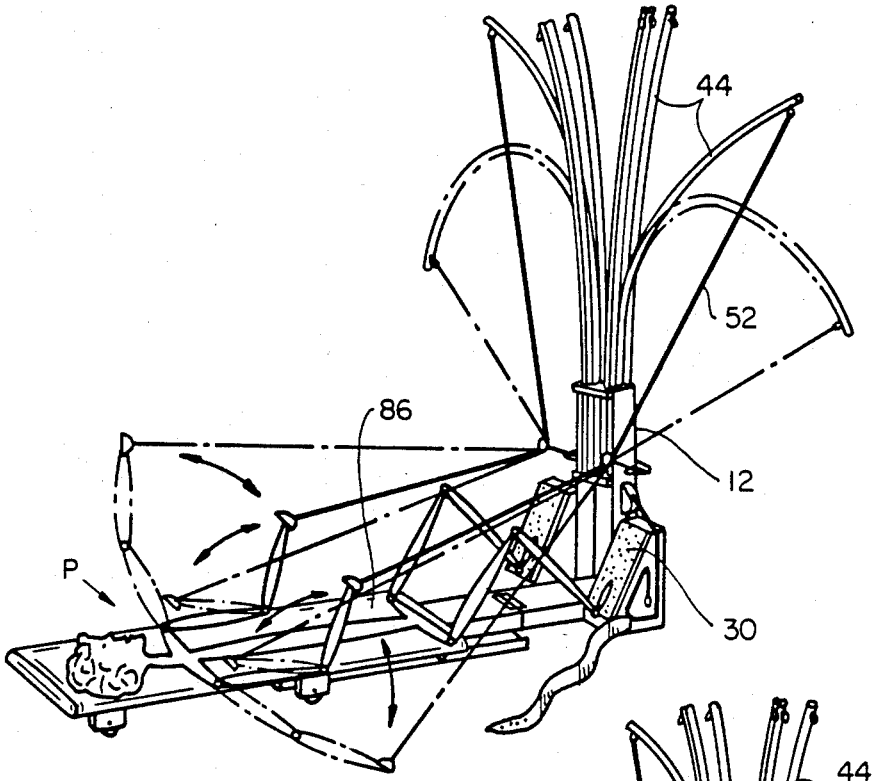

In FIG. 22 the individual assumes the same position as shown in FIG. 19. He or she pushes his or her body by using the legs against foot supports 30, thereby exercising the thigh and calf muscles.

It is obvious that many other modifications of the universal exercising machine are possible. For example, the resilient rods can be made of spring metal, bench frame can be made of plastic material, other types of connections apart from spring clips can be used for connecting cables to the resilient rods or other parts of the machine. Furthermore, the exercises and positions of the individual's body on the machine were shown only as illustrative but not limitative. It is obvious also that attachments and harness elements can vary according to individual's needs. Therefore the scope of the invention should be determined, not by the the examples given, but by the appended claims and their legal equivalents.

What I claim is:

1. In an exercising machine: a base, resilient rod mounted on the base in cantilevered fashion with one end of the rod being secured in a fixed position and the other end being free, a cable connected to the free end of the rod for flexing the rod when pulled, and means engageable with the cable for guiding the cable and operatively positioned such that a pull exerted upon the cable by a user, causes the rod to flex and resist the pull in a predetermined manner regardless of the direction in which the pull is exerted.

2. The exercising machine of claim 1 including a hand grip connected to the cable for engagement by the hand of a person using the machine.

3. The exercising machine of claim 1 including a bar connected to the cable for engagement by the hands of a person using the machine.

4. The exercising machine of claim 1 including a foot stirrup connected to the cable for engagement by the foot of a person using the machine.

5. The exercising machine of claim 1 including a belt connected to the cable for engagement with the waist of a person using the machine.

6. The exercising machine of claim 1 including a strap connected to the base for securing the body of the person using the machine in a predetermined position on the base.

7. The exercising machine of claim 1 including a seat movably mounted on the base and connected to the cable for receiving the body of the person using the machine.

8. The exercising machine of claim 7 wherein the base is adapted to rest on a horizontal supporting surface, and the seat includes wheels engageable with the supporting surface.

9. The exercising machine of claim 1 wherein the base and the fixed end of the resilient rod are hingedly connected together for movement between a working position in which the rod extends in a direction generally perpendicular to the base and a collapsed position in which the rod is generally parallel to the base.

10. The exercising machine of claim 1 wherein the guide means comprises a sheave pivotally mounted on the base near the fixed end of the rod.

11. The exercising machine of claim 1 including at least one additional resilient rod and means for selectively connecting the cable to the free ends of any desired number of the rods.

12. In an exercising machine: a base, a plurality for resilient rods mounted on the base in cantilevered fashion with one end of each of the rods being free, a flexible cable adapted to be pulled upon by a person using the machine , and means for connecting the cable selectively to one or more of the rods so that the rods to which the cable is connected bend in bow-like fashion and thereby produce a force which opposes the pull on the cable, the magnitude of the force depending at least in part upon the number of rods to which the cable is connected.

13. The exercising machine of claim 12 wherein the means for connecting the cable to the rods comprises hook means carried by the flexible cable and the free ends of the rods.

14. The exercising machine of claim 13 wherein the hook means comprises an eyelet connected to the free end of each of the rods and a hook member connected to the cable.

15. The exercising machine of claim 12 including a guide member for the cable mounted on the base near the fixed ends of the rods.

16. The exercising machine of claim 12 including a seat movable in a horizontal direction relative to the base for receiving the person using the machine.

17. The exercising machine of claim 16 wherein the cable is connected to the seat, and the rods to which the cable is connected are bent in bow-like fashion by movement of the seat.

18. The exercising machine of claim 12 wherein the rods are fabricated of nylon.

19. In an exercising machine: a base having a relatively short upright post, a bench extending from the post, a pair of foot supports on opposite sides of the post for receiving the feet of a person sitting or reclining on the bench, a plurality of vertically extending rods of resilient material mounted on the post in cantilevered fashion with the lower ends of the rods being rigidly affixed to the post and the upper ends of the rods being free, and means selectively connected to the rods and operable by a person on the bench for bending the rods in bow-like fashion to produce a force which resists the bending.

20. The exercising machine of claim 19 wherein the rods are fabricated of nylon.

21. The exercising machine of claim 19 wherein the rods are of circular cross-section and different diameters and provide forces of different magnitudes when bent.

22. The exercising machine of claim 19 wherein the bench is movable in a horizontal direction relative to the post and the lower ends of the rods.

23. The exercising machine of claim 19 wherein the means for bending the rods comprises a flexible cable which is adapted to be pulled by the person and a guide member for the cable positioned near the lower ends of the rods.

24. The exercising machine of claim 19 including means hingedly connecting the bench to the post and permitting the machine to be folded to a position in which the bench is generally parallel and adjacent to the posts and the rods.

25. In an exercising machine: a base having a relatively short upright post, a bench extending from the post, a pair of foot supports on opposite sides of the post for receiving the feet of a person sitting or reclining on the bench, a plurality of vertically extending rods of resilient material mounted on the post in cantilevered fashion with the lower ends of the rods being rigidly affixed to the post and the upper ends of the rods being free, a flexible cable upon which an axial pull can be exerted by a person on the bench, a guide member for the cable near the lower ends of the rods, and hook means carried by the cable and the free ends of the rods for selectively connecting the cable to one or more of the rods so that the rods are bent by the pull on the cable to produce a force which resists the pull.

26. The exercising machine of claim 25 wherein the rods are fabricated of nylon.

27. The exercising machine of claim 25 wherein the rods are of different sizes and produce forces of different magnitudes when bent in a similar manner.

28. The exercising machine of claim 25 wherein the hook means comprises eyelets connected to the free ends of the rods and a hook member connected to the cable for selective engagement with the eyelets.

29. The exercising machine of claim 25 including means hingedly connecting the bench to the post and permitting the machine to be folded to a position in which the bench is generally parallel and adjacent to the posts and the rods.

* * * * *